US006135452A

United States Patent [19]

Yurchey

[11] Patent Number: 6,135,452

[45] Date of Patent: Oct. 24, 2000

[54] BOARD GAME WITH PIECES OF VARYING POWER

[76] Inventor: Douglas S. Yurchey, 18615 Bryant St., Apt. 6, Northridge, Calif. 91324

[21] Appl. No.: 09/270,951

[22] Filed: Mar. 16, 1999

[51] Int. Cl.[7] ..... A63F 3/02

[52] U.S. Cl. ..... 273/260; 273/288; 273/290

[58] Field of Search ..... 273/260, 261, 273/288, 290, 291, 289

[56] References Cited

U.S. PATENT DOCUMENTS

| | | |
|---|---|---|
| 3,495,831 | 2/1970 | Healy . |
| 3,588,114 | 6/1971 | Vogel . |
| 3,642,286 | 2/1972 | Moore . |
| 3,751,039 | 8/1973 | Dykosky . |
| 4,019,746 | 4/1977 | Hare . |
| 5,280,913 | 1/1994 | Sirk . |
| 5,314,189 | 5/1994 | Kerivan . |
| 5,556,099 | 9/1996 | Mardirosian . |
| 5,586,762 | 12/1996 | Wearley . |
| 5,642,885 | 7/1997 | Gustin . |

*Primary Examiner*—Jeanette Chapman
*Assistant Examiner*—V K Mendiratta
*Attorney, Agent, or Firm*—Walter Unterberg

[57] ABSTRACT

A family of five board games with chess-like features played on a board of 64 white and off-white squares by two opposing players. Each player moves 16 pieces arrayed on the two rows closest to the player: 8 hollow domes each named RxM where x=A,E,I,O or U, on the back row; and 8 smaller solid hemispheres each named VOID on the second row. Four games are played with 8 identical RxMs per player, a RAM moving like a Rook, a REM like a Queen, a RIM like a Knight, and a ROM like a Bishop. The object of these games is to capture all the opponent's pieces. The fifth game has two each RAMs, RIMs, ROMs, and two RUMs moving like Kings, on the back row. The object here is to capture both RUMs of the opponent. In all versions a VOID moves like a Pawn. Different colors are assigned to the pieces in the different games and for the two players. The unique feature in all five games is the ability to create a third, more powerful, piece called RxMVOID moving like a Queen by covering a VOID on any square with a RxM. The RxMVOID can later be un-created by moving the RxM away from its VOID, when the separated pieces again assume their normal moves. Each game permits the players to focus on a different chess piece. Skill in these games can be acquired fast, and the possibilities, with the RxMVOID feature, become endless.

11 Claims, 7 Drawing Sheets

R-VOID BOARD AND TYPICAL STARTING LINE UPS

FIG. 1 STARTING LINE UPS OF ALL R-VOID GAMES
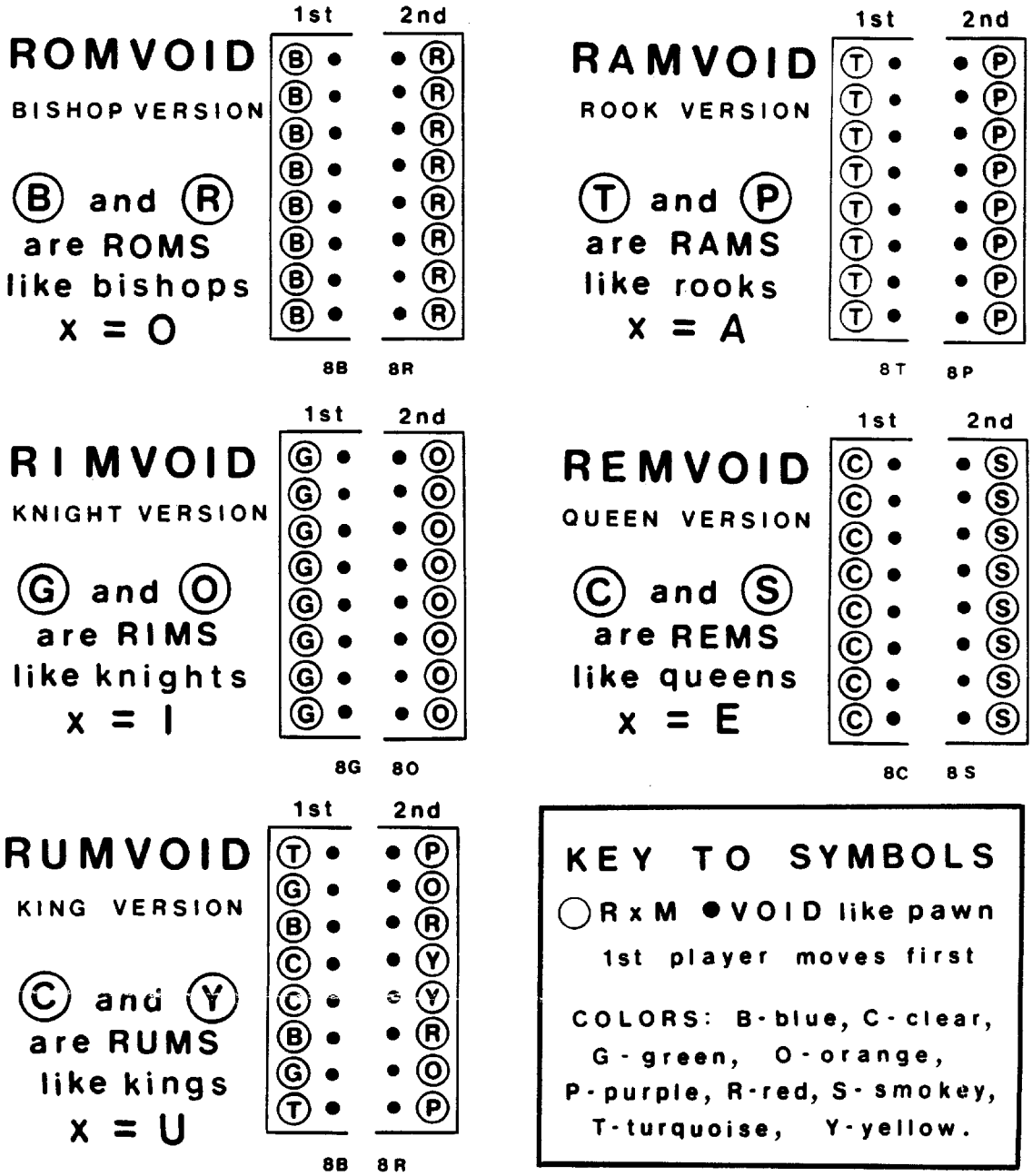

FIG. 2 R-VOID BOARD AND TYPICAL STARTING LINE UPS
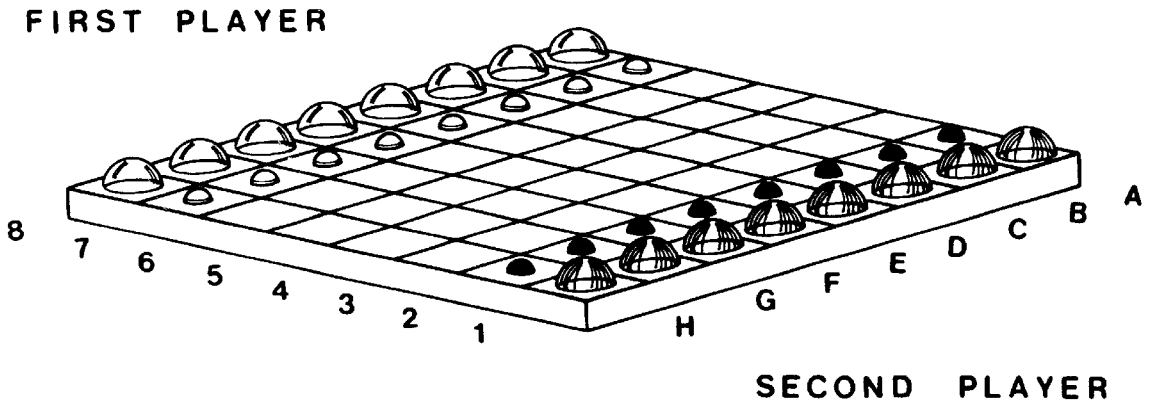
FIG. 3 GAME SCORE SYMBOLS
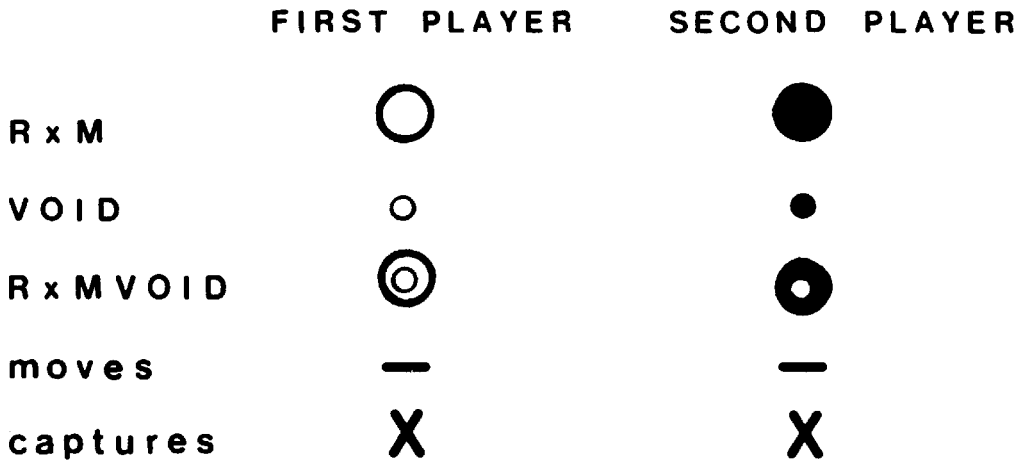

FIG.4 SAMPLE RAMVOID (rook) GAME

| FIRST PLAYER | | SECOND PLAYER | |
|---|---|---|---|
| TURQUOISE | | PURPLE | |
| 1. ○ f7 - f5 | Turquoise moves 1st | 1. ● e2 - e4 | |
| 2. ○ f5 X ● e4 | | 2. ● e1 X ○ e4 | |
| 3. ○ d7 - d5 | Pressures e4 RAM | 3. ● e4 - e3 | Evades |
| 4. ○ d4 - d4 | | 4. ● f3 - d3 | |
| 5. ◯ e8 - ◎ e7 | Creates RAMVOID | 5. ● d1 - d2 | |
| 6. ○ c7 - c5 | Protects d4 VOID | 6. ● b2 - b4 | |
| 7. ○ c5 X ● b4 | | 7. ● b1 X ○ b4 | |
| 8. ○ h7 - h6 | | 8. ● d3 X ○ d4 | |
| 9. ◯ a8 - ◎ a7 | Creates RAMVOID | 9. ● f1 - e1 | Threatens e7 RAMVOID |
| 10. ◎ e7 - f7 | Evades & threatens f2 & a2 | 10. ● a1 - ◉ g2 | Creates RAMVOID |
| 11. ◎ a7 X ● a2 | Un-creates & captures | 11. ● a1 X ◯ a2 | |
| 12. ◎ f7 X ● a2 | | 12. ● b4 X ○ b7 | |
| 13. ◯ b8 X ● b7 | | 13. ◉ g2 X ◯ b7 | |
| 14. ◯ g8 - ◎ g7 | Creates RAMVOID (errors) RAMVOID threatens b7 & d4 | 14. ◉ b7 X ◎ g7 | Un-creates & captures, deposited VOID threatens c8 |
| 15. ◯ c8 - b8 | Evades b7 VOID | 15. ● e1 - e7 | |
| 16. ◯ f8 X ● f2 | | 16. ◉ d2 X ◯ f2 | |
| 17. ◯ d8 X ● d4 | (errors) | 17. ◉ f2 X ◯ d4 | |
| 18. ◯ h8 - ◎ h6 | Creates RAMVOID | 18. ● e7 - ◉ b7 | Creates RAMVOID |
| 19. ◯ b8 X ◉ b7 | | 19. ● g7 X ◯ b7 | |
| 20. ◎ h6 - c6 | | 20. ● b7 X ○ a7 | |
| 21. ◎ a2 X ● a7 | | 21. ◉ d4 X ◎ a7 | |

Turquoise only has one RAMVOID left and RESIGNS. Purple is two RAMS and two VOIDS ahead of Turquoise. Purple WINS.

FIG. 5 SAMPLE REMVOID (queen) GAME

| FIRST PLAYER CLEAR | | SECOND PLAYER SMOKEY | |
|---|---|---|---|
| 1. ○ d7 - d5 | Clear moves first | 1. ● e2 - e4 | |
| 2. ○ d5 X ● e4 | | 2. ● e1 X ○ e4 | |
| 3. ◯ c8 - ◎ b7 | Creates REMVOID | 3. ● d1 - f3 | Supports e4 REM |
| 4. ◯ e8 - ◎ e7 | Creates REMVOID | 4. ● e4 - f4 | Evades Clear's attack |
| 5. ○ g7 - g5 | | 5. ● f4 - f5 | Evades VOID |
| 6. ◎ e7 - ◎ g5 | Un-creates | 6. ● h1 - ◉ h2 | Creates REMVOID |
| 7. ◯ f8 - ◎ f7 | Creates REMVOID | 7. ● f5 - ◉ c2 | Creates REMVOID |
| 8. ◯ b8 - ◎ a7 | Creates REMVOID | 8. ● f3 - h3 | |
| 9. ◎ b7 - ◯ a6 | Un-creates | 9. ● a2 - a3 | Deflects Clear's attack |
| 10. ◯ a6 X ● f1 | | 10. ● g1 X ◯ f1 | (errors) wrong REM X |
| 11. ◎ a7 X ● f2 | Un-creates | 11. ● f1 - ◉ g2 | Creates REMVOID |
| 12. ◯ h8 - d4 | Pressuring d2 | 12. ◉ h2 X ○ c7 | Un-creates & X |
| 13. ◯ f2 X ● d2 | | 13. ● c7 X ○ b7 | |
| 14. ◯ a8 X ● b7 | | 14. ◉ g2 X ◯ b7 | Un-creates & X |
| 15. ◯ d2 X ● g2 | | 15. ◉ c2 X ◯ g2 | Un-creates & X |
| 16. ○ a7 - a5 | | 16. ● b2 - b4 | |
| 17. ◯ d4 X ● a1 | | 17. ● b1 X ◯ a1 | |
| 18. ○ a5 X ● b4 | | 18. ● a3 X ○ b4 | |
| 19. ◎ g5 - ◯ f4 | Un-creates | 19. ● b4 - b5 | |
| 20. ◯ g8 - ◎ g5 | Creates REMVOID | 20. ● b5 - b6 | |
| 21. ◯ f4 X ● c1 | | 21. ● a1 - a3 | |
| 22. ○ e7 - e5 | | 22. ● b7 - b6 | Hides |
| 23. ◎ f7 - ◎ h7 | Un-creates | 23. ● h3 - ◉ h2 | Creates REMVOID |
| 24. ○ e5 - e4 | | 24. ● c3 - ◉ c2 | Creates REMVOID |
| 25. ○ e4 - e3 | | 25. ● b6 X ◯ d8 | Un-creates & X |
| 26. ◎ g5 X ● d8 | Un-creates & X | 26. ◉ c2 X ◯ c1 | Un-creates & X |
| 27. ◯ d8 X ● b6 | | 27. ● g2 X ○ g5 | |
| 28. ◯ b6 - ◎ e3 | Threatens REMS | 28. ◉ h2 - ● e5 | Un-creates REMVOID |
| 29. ◎ e3 X ● c1 | | 29. ● g5 X ○ e3 | |
| 30. ◯ c1 X ● c2 | | 30. ● e5 - ◉ h2 | Return to REMVOID |
| 31. ○ f7 - f5 | (errors) | 31. ◉ h2 X ◯ c2 | |
| 32. ○ f5 - f6 | Recovers | 32. ● e3 X ○ f4 | Attacks |
| 33. ◎ h7 X ● c2 | | 33. ● f4 - ◉ h2 | Creates REMVOID |
| 34. ◯ c2 - ◎ h7 | Creates REMVOID | /NO WINNER: One REMVOID to one REMVOID | |

FIG.6 SAMPLE RIMVOID (knight) GAME

| FIRST PLAYER GREEN | | SECOND PLAYER ORANGE | |
|---|---|---|---|
| 1. ● e2 - e4 | Green moves first | 1. ○ e7 - e5 | |
| 2. ● c1 - d3 | Threatens e5 VOID | 2. ○ f7 - f6 | Protects e5 VOID |
| 3. ● d1 - ◉ f2 | Creates RIMVOID | 3. ◯ d8 - ⊚ b7 | |
| 4. ● d3 X ○ e5 | Baiting Orange | 4. ◯ e8 - ⊚ f6 | Salvages mistake |
| 5. ● b2 - b3 | Defends | 5. ⊚ f6 X ● e4 | Un-creates & X |
| 6. ◉ f2 - f3 | | 6. ◯ a8 - ⊚ c7 | Creates RIMVOID |
| 7. ● e1 - d3 | Protects e5 RIM | 7. ◯ f8 - ⊚ b7 | Supports c4 RIM |
| 8. ● f1 - ◉ h2 | Creates RIMVOID | 8. ⊚ h7 - ⊚ f6 | Un-creates |
| 9. ◉ f3 X ⊚ f6 | | 9. ◯ e4 X ◉ f6 | |
| 10. ● g2 - g3 | Setting up RIMVOID | 10. ◯ c8 - ⊚ a7 | Creates RIMVOID |
| 11. ● h1 - ◉ g3 | Createa RIMVOID | 11. ⊚ a7 X ● a2 | |
| 12. ◉ h2 X ○ h7 | | 12. ⊚ a2 X ● b1 | |
| 13. ◉ h7 X ◯ h8 | | 13. ⊚ b1 X ● a1 | |
| 14. ◉ h8 X ○ g7 | | 14. ⊚ c7 X ● c2 | |
| 15. ◉ g7 X ◯ g8 | | 15. ◯ f6 - e4 | Threatens g3 |
| 16. ◉ g3 - f3 | Evades attack | 16. ⊚ b7 X ● b3 | |
| 17. ◉ f3 X ◯ e4 | | 17. ⊚ b7 X ◉ e4 | |
| 18. ◉ g8 X ◯ b8 | | 18. ⊚ a1 X ● g1 | |
| 19. ◉ b8 X ○ d7 | Un-creates & X | 19. ⊚ e4 X ● d2 | Threatens d3 RIM |
| 20. ● d3 - c5 | Evades VOID attack | 20. ◯ d2 X ● b3 | |
| 21. ● c5 - a6 | Setting up RIMVOID | 21. ◯ b3 - c5 | |
| 22. ● a6 - ◉ b8 | Creates RIMVOID | 22. ◯ c5 X ● d7 | Exchanges |
| 23. ● e5 X ◯ d7 | | 23. ⊚ c2 - e2 | |
| 24. ◉ b8 - e8 | | 24. ⊚ g1 - e3 | |
| 25. ● d7 - f6 | | 25. ○ e4 - e5 | Threatens RIM |
| 26. ● f6 - g8 | Evades VOID | 26. ○ e5 - e6 | |
| 27. ◉ e8 - ● f6 | Un-creates | 27. ⊚ e2 - d2 | |
| 28. ● f6 - ◉ e8 | Returns to R'VOID | 28. ⊚ d2 - d5 | |
| 29. ◉ e8 - g6 | | 29. ○ e6 - e7 | |
| 30. ◉ g6 - e8 | Returns to block | 30. ⊚ d5 X ● g8 | |
| 31. ◉ e8 X ⊚ g8 | | 31. ○ e7 - ⊚ e8 | VOID promotion to a RIMVOID |

The relocated VOID promotion to a RIMVOID gives Orange a RIMVOID advantage; two RIMVOIDS to one RIMVOID: Orange wins.

FIG. 7 SAMPLE ROMVOID(bishop) GAME

| FIRST PLAYER BLUE | SECOND PLAYER RED |
|---|---|
| 1. ○ d7 - d5 Blue moves first | 1. ● e1 - ◉ d2 Creates ROMVOID |
| 2. ◯ e8 - ◎ f7 Creates ROMVOID | 2. ● g2 - g3 |
| 3. ○ c7 - c6 Protects d5 VOID | 3. ● c2 - c4 Baits Blue's VOID |
| 4. ◯ f8 - ◎ e7 Creates ROMVOID | 4. ● c4 X ○ d5 |
| 5. ○ c6 - c5 | 5. ● d1 - b3 Setting up attack on both Blue ROMVOIDS |
| 6. ◎ e7 - ◎ c5 Un-creates then creates ROMVOID | 6. ● d5 - d6 ROM threatens Blue's f7 ROMVOID |
| 7. ◎ f7 X ● b3 Un-creates & X | 7. ● d6 - d7 VOID threatens Blue's c8 ROM |
| 8. ◯ c8 X ● d7 | 8. ● a2 X ◯ b3 |
| 9. ◯ d8 - ◎ e7 Creates ROMVOID | 9. ● c1 - ◉ b2 Creates ROMVOID |
| 10. ◯ g8 - ◎ f7 Protects g7 VOID | 10. ● g1 - ◉ h2 Creates ROMVOID |
| 11. ◎ f7 X ● f2 | 11. ◉ h2 X ○ h7 |
| 12. ◎ f2 X ● f1 | 12. ◉ h7 X ◯ h8 |
| 13. ◎ c5 - g1 Moves to attack | 13. ◉ h8 X ◯ b8 |
| 14. ◎ g1 X ● h1 | 14. ◉ b8 X ◯ a8 |
| 15. ◎ f1 X ● b1 | 15. ◉ a8 X ○ a7 |
| 16. ◯ d7 - c6 Moves to create | 16. ◉ b2 X ○ g7 |
| 17. ◯ c6 - ◎ b7 Creates ROMVOID | 17. ◉ g7 X ◎ e7 |
| 18. ◎ b1 X ● b3 Protects b7 | 18. ◉ a7 X ◎ b7 |

Blue RESIGNS being outnumbered in pieces.

FIG.8 SAMPLE RUMVOID (2 king) GAME
(with RAMS RIMS ROMS RUMS)

| FIRST PLAYER F.P. | | SECOND PLAYER S.P. | |
|---|---|---|---|
| 1. ○ f7 - f5 | F.P. moves first | 1. ● g1 - f3 | |
| 2. ◯ c8 - ◎ b7 | Creates ROMVOID | 2. ● f3 - d4 | RIM threatens f5 |
| 3. ○ g7 - g6 | Supports f5 VOID | 3. ● f1 - ⭘ e2 | Creates ROMVOID |
| 4. ◎ b7 X ● g2 | Threatens RAM | 4. ⭘ e2 - ● f3 | Un-creates, pressures g2 |
| 5. ◎ g2 X ● f3 | Un-creates & X, h1 VOID is threatened | 5. ● d4 X ◯ f3 | |
| 6. ○ g2 X ● h1 | | 6. ● f3 - ⭘ h2 | Creates RIMVOID |
| 7. ◯ g8 - ◎ e7 | Creates RIMVOID | 7. ⭘ h2 X ○ h1 | |
| 8. ◯ a8 - ◎ a7 | Creates RAMVOID | 8. ● c1 - ⭘ b2 | Creates ROMVOID, threatens h8 |
| 9. ◎ e7 - ◎ f5 | Un-creates & creates | 9. ⭘ b2 X ◯ h8 | |
| 10. ◯ d8 - ◎ c7 | Creates RUMVOID | 10. ⭘ h8 X ○ h7 | (errors) |
| 11. ◎ f5 X ● c2 | | 11. ● d1 - ⭘ e2 | RUM evades, will lose a RUM |
| 12. ◎ c2 X ● e1 | Un-creates, VOID threatens b1 | 12. ⭘ h1 X ◯ e1 | Will attack RUM |
| 13. ◯ b8 - ◎ d7 | Creates RIMVOID | 13. ⭘ h7 X ○ g6 | |
| 14. ◯ e8 - d8 | RUM evades ROMVOID | 14. ⭘ e1 X ○ c2 | Un-creates & X |
| 15. ◯ f8 - ◎ e7 | (CHIK) | 15. ⭘ e2 - ● d1 | Un-creates, RUM evades attack |
| 16. ◎ a7 - a5 | | 16. ● b1 - ⭘ d2 | Creates RIMVOID |
| 17. ◎ c7 - c3 | | 17. ⭘ d2 - ● e4 | Doubly threatens c3 |
| 18. ◎ e7 X ● e4 | | 18. ⭘ g6 X ◎ e4 | d2 VOID is stuck |
| 19. ◎ d7 X ● d2 | (CHIK) | 19. ● e1 X ◎ d2 | |
| 20. ◎ c3 X ● d2 | (MATE) | | |

F.P.'s RUMVOID is protected and mates S.P.'s second RUM.

F. P. wins.

BOARD GAME WITH PIECES OF VARYING POWER

RELATED DOCUMENTS

This application covers the invention disclosed in Disclosure Document No. 431082 filed Feb. 27, 1998 with the U.S. Patent and Trademark Office.

BACKGROUND OF THE INVENTION

1. Field of the Invention

This invention relates to games played by two opponents on a square board of sixty-four squares, like chess and checkers. More particularly, it relates to games wherein pieces of two different types can be combined to create a third, more powerful, type of piece. During the course of a game a plurality of pieces of the third type may be created by either player. Also, pieces of the third type may later be un-created, i.e., the component pieces may be separated and again assume their original individual, less powerful, functions. The object of the game is to remove all the opponent's pieces.

2. Description of Related Art

Games in which two opponents move pieces of various types on a squared board have been played in civilizations all over the globe going back to antiquity. Currently, the games of chess and checkers, both played on a square board of sixty-four squares, have assumed major importance and are being played recreationally and in organized competitions by millions of people of both genders and all ages.

In both games there are pieces which only move forward from their starting positions at or near a player's baseline toward the opponent's baseline. Such pieces are all the men in checkers and only the pawns in chess. In both games any man or pawn reaching the opponent's baseline is transformed into a more powerful piece, such as a King in checkers or a Queen (or other major piece) in chess. Such crowning of a man or promotion of a pawn takes place at the opponent's baseline, and not at any other place on the board, and are not reversible. As a result of these and other well-explored basic rules in traditional checkers and chess, many offshoot board games incorporating some features of checkers and/or chess have been proposed.

A search of the U.S. patent literature was undertaken with the specific purpose of finding board games with features similar to crowning or pawn promotion at any point in the game, or any reversal of these events. The following U.S. Pat. Nos. were found:

3,186,716 to Shabarick,
4,019,746 to Hare,
4,032,152 to Schifman,
4,391,449 to Johnson,
45 4,552,364 to Shaffer,
5,340,114 to Wester,
5,351,965 to Telfer et al,
5,472,208 to Berry, and
5,509,662 to Santianni.

A survey of these nine board games indicated that all except Shaffer, Berry and Santianni had boards of 64 squares, mostly in two alternating colors. A variety of piece types and game rules occur. Shaffer adds a "home stone" in mid-game as a target for capture by the opponent to end the game. Wester uses chance to select 12 playing pieces from a lineup of 15 pieces.

In the matter of promotion or crowning, Schifman has a Key Marker which sits on a Courier Peg as two piece types.

To win, one must transport a Key Marker on a Courier Peg of one's own or belonging to the opponent to the opponent's baseline. In Berry's game one player moves Pegs and the other player moves Rings, with captures by placing one type of piece over the other type.

The games of Hare, Johnson and Wester provide for a promotion just like pawn promotion in chess, only when the less powerful piece reaches the opponent's baseline. None of these games include a promotion feature in the middle of the board, or a provision to uncreate the promotion.

OBJECTS OF THE INVENTION

It is an object of this invention to provide a family of board games which is a new challenge for chess and checker players on the familiar sixty-four-square board with sixteen pieces occupying the first two and last two rows of the board, but with pieces in various novel starting positions and with novel strategies.

It is another object to provide a family of board games which can be learned in a short time, and in which a reasonable level of skill can be reached after playing a few games.

It is a further object to provide a family of board games, all versions of which share the novel feature that two types of pieces can be combined into a third, more powerful, piece on a single square anywhere on the board; and further, that these more powerful pieces can be created and un-created during the course of a game.

It is yet another object to provide a family of board games, each version of which emphasizes the moves of a different chess piece, such as bishop, rook, knight, king and queen.

It is still another object to provide a family of board games, all versions of which are sufficiently similar to each other, so that switching from one version to another is not too difficult, thus permitting players to improve their skills in moving a different chess piece in each version.

It is a further object to provide a family of board games in which there are only two types of pieces of simple geometry which are simple to fabricate and a board with basically mono-chrome squares so that the games can be offered at a low price.

SUMMARY OF THE INVENTION

To implement the stated objects of the invention, a family of board games named R-VOID has been devised, all played on a board of sixty-four white and off-white squares by two opposing players. The pieces are of two types: RxM, where x is one of the five vowels (A,E,I,O,U)), in the shape of a tinted-colored transparent hollow dome; and VOID in the shape of a solid-colored hemisphere small enough to fit completely under an RxM dome on one square of the board.

At the start each player has sixteen pieces: eight RxMs on each player's back row or baseline, and eight VOIDs on each player's second row. The five different game versions corresponding to the five vowels are distinguished by differently colored pieces for both players, i.e., there are ten color-coded sets of pieces.

Further, the versions are different from one another in that each RxM moves in a different way, all ways being related to chess: the RAM like a Rook: the REM like a Queen; the RIM like a Knight; the ROM like a Bishop; and the RUM like a King. The VOID, however, moves alike in all five versions, namely, like a Pawn in chess, with the ability to capture diagonally and "en passant.

FIG. 1 shows the colors and starting lineups for all five R-VOID vrersions. The colors are as follows for the game versions named RAMVOID, REMVOID, RIMVOID and ROMVOID, with sixteen pieces per color:

| | 1st player | 2nd player |
|---|---|---|
| RAMVOID (8 RAMS + 8 VOIDs) | Turquoise | Purple |
| REMVOID (8 REMS + 8 VOIDs) | Clear | Smokey |
| RIMVOID (8 RIMs + 8 VOIDs) | Green | Orange |
| ROMVOID (8 ROMs + 8 VOIDs) | Blue | Red |

For RUMVOID the 8 RxMs are mixed, but include 2 RUMs in the center, plus 8 VOIDS, thus:

1st player RUMVOID: Back row from end to end:

RAM(turquoise)-RIM(green)-ROM(blue)-RUM (clear)-RUM(clear)-ROM(blue)-RIM(green)-RAM (turquoise).

Second row: 8 VOIDs (blue).

2nd player RUMVOID: Back row from end to end:

RAM(purple)-RIM(orange)-ROM(red)-RUM(yellow)-RUM(yellow)-ROM(red)-RIM(orange)-RAM (purple).

Second row: 8 VOIDs (red).

The rules of play for the first four versions (RAMVOID, REMVOID, RIMVOID, and ROMVOID) are closely the same and are described first. The rules for RUMVOID are described afterwards.

Rules for RxMVOID, with x=A,E,I or O.

The object of the game is to capture (i.e., remove from the board) all your opponent's pieces; and, conversely, to defend your own pieces. In addition to the two types of pieces (RxM and VOID) in the starting lineup, a third, more powerful, piece called RxMVOID can be created during play anywhere on the board by combining an RxM with a VOID of the same color.

This is done when a hollow dome RxM covers, or 'engages', the smaller solid VOID on its square in a separate move. Such a move may, for RAMs and ROMs take place across several clear squares, but not across squares occupied by other VOIDs. Further, a RxM can 'disengage' from a RxMVOID by moving away (like a Rook, Queen, Knight or Bishop, depending on the vowel) from its covered VOID and leave the VOID behind. The tinted transparent RxM domes allow visual inspection of whether a VOID is present underneath a RxM.

A RAMVOID, RIMVOID or ROMVOID, when created, moves like a Queen in chess, but a REMVOID becomes a fixed "safety base" which cannot be attacked or captured. When a RxMVOID (but not x=E) moves, it takes its VOID with it and 'relocates' it. A REMVOID cannot move, but its REM can disengage from the square of the REMVOID and move or attack as a Queen, leaving the VOID behind.

When a VOID on its own reaches the other end of the board (i.e., the opponent's back row), like a Pawn in chess, it becomes a RxMVOID. However, if a relocated VOID is deposited at the other end of the board, it cannot become a a RxMVOID, but it can be combined into a RxMVOID by another RxM (not x=E) and once again be relocated.

If such a relocated VOID is deposited on the fifth (or farther removed) rank from the opponent's back row, it can then march the last four (or more) squares on its own to the opponent's back row and become a RxMVOID. A relocated VOID can also be deposited on a player's back row (one square behind the VOID starting line) from which the VOID can again march forward, one square at a time, or be engaged again into a RxMVOID.

The outcome of a game can be a win for the player who has captured all his opponent's pieces, or a draw if both players have the same number of pieces and agree to a draw. If a player gets hopelessly behind in material, he may opt to resign.

Rules for RUMVOID

In RUMVOID the starting lineup is similar to chess except that the back row has two RUMs, moving like Kings in chess, on the central squares instead of King and Queen. On either side of the two RUMs there is a chess-like lineup of ROM (like Bishop), RIM (like Knight) and RAM (like Rook), the latter in the corners. The color of all pieces are as described on page 4 above and in FIG. 1. Thus RUMVOID is color-coded chess, but with two Kings and no Queen, and the ability to engage and disengage.

The object of this game version is to capture both RUMs of the opponent. When a player has lost one RUM and has not captured a RUM of the opponent, that player is in danger of losing the game if the other RUM is captured. When a player attacks the opponent's remaining RUM, that player says 'chik', similar to 'check' in chess, as a warning. No warning is given when the attacked player still has both RUMs on the board.

The engagement of a RAM, RIM, ROM or RUM with a VOID results in a RAMVOID, RIMVOID, ROMVOID or RUMVOID, all of which move like a Queen in chess. When such a RxMVOID (x=A,I,O,U) disengages on a square, the RxM moves away according to its normal piece motion. When a VOID reaches the opponent's back row on its own, it can be promoted to a RAM (like Rook), RIM (like Knight) or ROM (like Bishop) at the promoting player's choice.

Another chess-like feature here is 'double castling' which means that the left-sided RUM can only castle (O—O) with the RAM in the left corner, and similarly for the right-sided RUM and RAM. A player may opt to castle once, twice or not at all.

The outcome of RUMVOID can be (1) a win for the player who has captured a RUM of his opponent and then 'mated' the remaining rum; (2) a draw if both players have the same number of pieces and agree to a draw; or (3) a draw by stalemate, as in chess, when the attacked player has no choice but to move the remaining RUM to a square where it would be captured. If a plyer gets hopelessly behind in material, he may opt to resign.

BRIEF DESCRIPTION OF THE DRAWINGS

A better understanding of the invention may be gained by reference to the following Detailed Description in conjunction with the drawings provided in which:

FIG. 1 illustrates the starting lineup of all five versions of the R-VOID game with indications of the color combinations assigned to the different game versions;

FIG. 2 is a pictorial view of the R-VOID game board and typical pieces in the starting lineup with an indication of the algebraic coordinates used to identify each square on the board;

FIG. 3 shows the game score symbols for pieces, moves and it captures for both the first player and the second player;

FIG. 4 is the game score of a sample RAMVOID game;

FIG. 5 is the game score of a sample REMVOID game;

FIG. 6 is the game score of a sample RIMVOID game;

FIG. 7 is the game score of a sample ROMVOID game; and

FIG. 8 is the game score of a sample RUMVOID game.

DETAILED DESCRIPTION OF THE PREFERRED EMBODIMENTS

Referring to FIG. 1, the starting lineups of all five R-VOID game versions are shown. These versions are called RAMVOID, REMVOID, RIMVOID, ROMVOID and RUMVOID. They are derived from the generic RxMVOID where x becomes a different alphabetical vowel in each version.

At the start each player has sixteen pieces: eight RxMs on each player's back row or baseline, and eight VOIDs on each player's second row. The five different game versions corresponding to the five vowels are distinguished by differently colored pieces for both players, i.e., there are ten color-coded sets of pieces.

Further, the versions are different from one another in that each RxM moves in a different way, all ways being related to chess: the RAM like a Rook: the REM like a Queen; the RIM like a Knight; the ROM like a Bishop; and the RUM like a King. The VOID, however, moves alike in all five versions, namely, like a Pawn in chess, with the ability to capture diagonally and "en passant.

FIG. 1 shows the colors and starting lineups for all five R-VOID vrersions. The colors are as follows for the game versions named RAMVOID, REMVOID, RIMVOID and ROMVOID, with sixteen pieces per color:

| | 1st player | 2nd player |
|---|---|---|
| RAMVOID (8 RAMS + 8 VOIDs) | Turquoise | Purple |
| REMVOID (8 REMS + 8 VOIDs) | Clear | Smokey |
| RIMVOID (8 RIMS + 8 VOIDs) | Green | Orange |
| ROMVOID (8 ROMS + 8 VOIDs) | Blue | Red |

For RUMVOID the 8 RxMs are mixed, but include 2 RUMs in the center, plus 8 VOIDs, thus:

1st player RUMVOID: Back row from end to end:

RAN((turquoise)-RIM(green)-ROM(blue)-RUM (clear)-RUM(clear)-ROM(blue)-RIM(green)-RAM (turquoise).

Second row: 8 VOIDs (blue).

2nd player RUMVOID: Back row from end to end:

RAM(purple)-RIM(orange)-ROM(red)-RUM(yellow)-RUM(yellow)-ROM(red)-RIM(orange)-RAM (purple).

Second row: 8 VOIDs (red).

The rules of play for the first four versions (RAMVOID, REMVOID, RIMVOID, and ROMVOID) are closely the same and are described first. The rules for RUMVOID are described afterwards.

Rules for RxMVOID, with x=A,E,I or O.

The object of the game is to capture (i.e., remove from the board) all your opponent's pieces; and, conversely, to defend your own pieces. In addition to the two types of pieces (RxM and VOID) in the starting lineup, a third, more powerful, piece called RxMVOID can be created during play anywhere on the board by combining an RxM with a VOID of the same color.

This is done when a hollow dome RxM covers, or 'engages', the smaller solid VOID on its square in a separate move. Such a move may, for RAMs and ROMs take place across several clear squares, but not across squares occupied by other VOIDs. Further, a RxM can 'disengage' from a RxMVOID by moving away (like a Rook, Queen, Knight or Bishop, depending on the vowel) from its covered VOID and leave the VOID behind. The tinted transparent RxM domes allow visual inspection of whether a VOID is present underneath a RxM.

A RAMVOID, RIMVOID or ROMVOID, when created, moves like a Queen in chess, but a REMVOID becomes a fixed "safety base" which cannot be attacked or captured. When a RxMVOID (but not x=E) moves, it takes its VOID with it and 'relocates' it. A REMVOID cannot move, but its REM can disengage from the square of the REMVOID and move or attack as a Queen, leaving the VOID behind.

When a VOID on its own reaches the other end of the board (i.e., the opponent's back row), like a Pawn in chess, it becomes a RxMVOID. However, if a relocated VOID is deposited at the other end of the board, it cannot become a a RxMVOID, but it can be combined into a RxMVOID by another RxM (not x=E) and once again be relocated.

If such a relocated VOID is deposited on the fifth (or farther removed) rank from the opponent's back row, it can then march the last four (or more) squares on its own to the opponent's back row and become a RxMVOID. A relocated VOID can also be deposited on a player's back row (one square behind the VOID starting line) from which the VOID can again march forward, one square at a time , or be engaged again into a RxMVOID.

The outcome of a game can be a win for the player who has captured all his opponent's pieces, or a draw if both players have the same number of pieces and agree to a draw. If a player gets hopelessly behind in material, he may opt to resign.

Rules for RUMVOID

In RUMVOID the starting lineup is similar to chess except that the back row has two RUMs, moving like Kings in chess, on the central squares instead of King and Queen. On either side of the two RUMs there is a chess-like lineup of ROM (like Bishop), RIM (like Knight) and RAM (like Rook), the latter in the corners. The color of all pieces are as described on page 4 above and in FIG. 1. Thus RUMVOID is color-coded chess, but with two Kings and no Queen, and the ability to engage and disengage.

The object of this game version is to capture both RUMs of the opponent. When a player has lost one RUM and has not captured a RUM of the opponent, that player is in danger of losing the game if the other RUM is captured. When a player attacks the opponent's remaining RUM, that player says 'chik', similar to 'check' in chess, as a warning. No warning is given when the attacked player still has both RUMs on the board.

The engagement of a RAM, RIM, ROM or RUM with a VOID results in a RAMVOID, RIMVOID, ROMVOID or RUMVOID, all of which move like a Queen in chess. When such a RxMVOID (x=A,I,O,U) disengages on a square, the RxM moves away according to its normal piece motion. When a VOID reaches the opponent's back row on its own, it can be promoted to a RAM (like Rook), RIM (like Knight) or ROM (like Bishop) at the promoting player's choice.

Another chess-like feature here is 'double castling' which means that the left-sided RUM can only castle (O—O) with the RAM in the left corner, and similarly for the right-sided RUM and RAM. A player may opt to castle once, twice or not at all.

The outcome of RUMVOID can be (1) a win for the player who has captured a RUM of his opponent and then 'mated' the remaining rum; (2) a draw if both players have the same number of pieces and agree to a draw; or (3) a draw by stalemate, as in chess, when the attacked player has no choice but to move the remaining RUM to a square where it would be captured. If a player gets hopelessly behind in material, he may opt to resign.

Referring now to FIG. 2, the basically monochrome sixty-four-square R-VOID board is shown with a typical starting lineup. The board can consist of alternating white and off-white squares. Symbolically, the pieces of the first player are shown open or white, and those of the second player filled in or dark. Squares are identified alphabetically by column and numerically by row. Thus the corner RxMs of the first player are located on squares a8 and h8, while those of the second player are located on a1 and h1.

Referring now to FIG. 3, the symbols for recording a game score are shown. The RxM, VOID and RxMVOID symbols are open or white for the first player, and filled in or dark for the second player. Dashes represent moves and lower case x's represent captures, just as in chess.

Referring now to FIG. 4 through FIG. 8, sample game scores for all five game versions are presented. In FIG. 4 a sample RAMVOID, or Rook, game is illustrated, with running commentary for both sides. The first player is Turquoise and the second player is Purple. After the first few moves Purple is slightly ahead. Turquoise errs on moves 14 and 17, resulting in only one RAMVOID remaining. This gives Purple the advantage of two RAMs and two VOIDs. In view of being far behind in material, Turquoise resigns and Purple wins.

Referring now to FIG. 5, a sample REMVOID, or Queen, game is illustrated, with running commentary for both sides. The first player is Clear and the second player is Smokey. After a close opening game, Clear seems to have the better position. On move 29 Clear captures a REM and appears to be winning. But on move 31 Clear makes an error and unprotects its REM on square c2. This lets Smokey back into the game, with equal materials, one REMVOID each, for both sides. The result is a draw.

Referring now to FIG. 6, a sample RIMVOID, or Knight, game is illustrated, with running commentary for both sides. The first player is Green and the second player is Orange. Right after the start of the game it is a battle between Orange's many RIMVOIDs and Green's numerous RIMS. After twists, turns and momentum changes, Orange has two RIMVOIDs to one RIMVOID for Green. Since Green is unable to mount an offensive to protect its VOID, he resigns and Orange wins.

Referring now to FIG. 7, a sample ROMVOID, or Bishop, game is illustrated, with running commentary for both sides. The first player is Blue and the second player is Red. After move 10 there is a feeding frenzy of capturing on both sides. Blue goes on the attack when it should have made some defensive moves. Consequently, at the end of the game Red is far ahead in material, while Blue is left with only two ROMVOIDs and opts to resign, and Red wins.

Referring now to FIG. 8, a sample RUMVOID, or Double King, game is illustrated. As indicated in FIG. 1, the first player has Clear RUMs, while the second player has Yellow RUMs. The chess-like lineup includes RAMs, RIMs and ROMs in the same colors as in the previous game versions. The first player has Turquoise RAMs, Green RIMS, Blue ROMS, and Blue VOIDs. The second player has Purple RAMs, Orange RIMs, Red ROMs and Red VOIDs.

As seen in the running commentary for both sides in FIG. 8, the first player announces "chik" to the remaining RUM of the second player on moves 15 and 19. This is analogous to announcing "check" in chess.

In the early moves of the sample game the second player (SP) did not see the attack of the first player (FP). One RUM of the SP must run, and the other RUM of the SP is captured by a disengaged RIM of the FP. The FP lines up many pieces to attack the VOID protecting the second RUM of the SP. After a final exchange, the FP's RUMVOID mates the SP's remaining RUM and wins the game.

The games described in FIG. 4 through FIG. 8 show some of the possibilities inherent in the R-VOID games. Skill in these games can be acquired fast and the possibilities become endless. Players can switch from one version to another to improve their skills in moving different chess pieces. The unique features of all versions are delineated in the appended claims.

What is claimed is:

1. A method of playing a board game with chess-like features for a first player opposing a second player, the method comprising the following steps:

providing a playing board having an eight by eight array of monochromatic playing squares;

providing two sets of playing pieces, each set having sixteen pieces of a different color, and comprising:

eight tinted-colored transparent hollow domes occupying a back row on said board at the start of a game; and eight solid-colored hemispheres, each small enough to fit under one of said hollow domes, occupying a second row on said board at the start of a game; with one said set moved by the first player and the other said set moved by the second player, a said back row being located at the edge of said board immediately in front of a said player;

moving a said solid-colored hemisphere on said playing board forward from its starting position like a pawn in chess with the ability to capture diagonally and "en passant", and to be promoted to a piece which moves like a Queen in chess when said hemisphere reaches a far end of said board;

moving a said hollow dome on said playing board like a chess piece other than King and Queen, with the ability to move to a square occupied by a said hemisphere and engage said hemisphere by covering said hemisphere with said hollow dome, thereby creating a more powerful combined piece which moves like a queen in chess and which can relocate said covered hemisphere by moving to another square, and with the further ability to uncreate said combined piece by moving said hollow dome away from said covered hemisphere and so disengage said hemisphere, said hollow dome and said hemisphere then moving separately as before the engagement; and alternating moves by the first player and the second player with the object of capturing all the enemy pieces.

2. The method of claim 1 wherein said chess piece is a Rook.

3. The method of claim 2 wherein a said hollow dome moving like a Rook is designated a RAM, a said hemisphere is designated a VOID, a said combined piece is designated a RAMVOID, and a promoted VOID becomes a combined-piece RAMVOID; a said set of pieces being colored purple for the first player and turquoise for the second player.

4. The method of claim 1 wherein said chess piece is a Knight.

5. The method of claim 4 wherein a said hollow dome moving like a Knight is designated a RIM, a said hemisphere is designated a VOID, a said combined piece is designated a RIMVOID, and a promoted VOID becomes a combined-piece RIMVOID; a said set of pieces being colored green for the first player and orange for the second player.

6. The method of claim 1 wherein said chess piece is a Bishop.

7. The method of claim 6 wherein a said hollow dome moving like a Bishop is designated a ROM, a said hemisphere is designated a VOID, a said combined piece is designated a ROMVOID, and a promoted VOID becomes a combined-piece ROMVOID; a said set of pieces being colored blue for the first player and red for the second player.

8. A method of playing a board game with chess-like features for a first player opposing a second player, the method comprising the following steps:

providing a playing board having an eight by eight array of monochromatic playing squares;

providing two sets of playing pieces, each set having sixteen pieces of a different color, and comprising:

eight tinted-colored transparent hollow domes occupying a back row on said board at the start of a game; and eight solid-colored hemispheres, each small enough to fit under one of said hollow domes, occupying a second row on said board at the start of a game; with one said set moved by the first player and the other said set moved by the second player, a said back row being located at the edge of said board immediately in front of a said player;

moving a said solid-colored hemisphere on said playing board forward from its starting position like a pawn in chess with the ability to capture diagonally and "en passant", and to be promoted to a piece which moves like a Queen in chess when said hemisphere reaches a far end of said board;

moving a said hollow dome on said playing board like a Queen in chess, with the ability to move to a square occupied by a said hemisphere and engage said hemisphere by covering said hemisphere with said hollow dome, thereby creating a combined-piece Safety Base fixed on the square of its creation and impregnable to enemy attack, with the further ability to uncreate a said combined-piece Safety Base by moving said hollow dome away from said covered hemisphere and so disengage said hemisphere, said hollow dome and said hemisphere then moving separately as before the engagement; and alternating moves by the first player and the second player with the object of capturing all the enemy pieces.

9. The method of claim 8 wherein a said hollow dome moving like a Queen is designated a REM, a said hemisphere is designated a VOID, a said combined-piece Safety Base is designated a REMVOID, and a promoted VOID becomes a combined-piece Safety Base REMVOID; said set of pieces being colored clear for the first player and smokey for the second player.

10. A method of playing a board game with chess-like features for a first player opposing a second player, the method comprising the following steps:

providing a playing board having an eight by eight array of monochromatic playing squares;

providing two sets of playing pieces, each set having sixteen pieces of a different color, and comprising:

eight tinted-colored transparent hollow domes occupying a back row on said board at the start of a game comprising two moving like Rooks in chess at the outer corner extremities, two moving like Knights in chess next to the Rook-like hollow domes, two moving like Bishops in chess next to the Knight-like hollow domes and two moving like Kings in chess on the two central squares of said back row, with the ability of left-hand and right-hand pairs of King-like and Rook-like hollow domes to engage in castling according to the laws of chess; and eight solid-colored hemispheres, each small enough to fit under one of said hollow domes, occupying a second row on said board at the start of a game;

with one said set moved by the first player and the other said set moved by the second player, a said back row being located at the edge of said board immediately in front of a said player;

moving a said solid-colored hemisphere on said playing board forward from its starting position like a pawn in chess with the ability to capture diagonally and "en passant", and, when advancing to a far end of said board, to be promoted to a piece which moves like a Rook, Knight or Bishop in chess at the player's choice;

moving a said hollow dome according to its position on said back row of said playing board, with the ability to move to a square occupied by a said hemisphere and engage said hemisphere by covering said hemisphere with said hollow dome, thereby creating a more powerful combined piece which moves like a Queen in chess and which can relocate said covered hemisphere by moving to another square, and with the further ability to uncreate said combined piece by moving said hollow dome away from said covered hemisphere and so disengage said hemisphere, said hollow dome and said hemisphere then moving separately as before the engagement; and alternating moves by the first player and the second player with the object of capturing both enemy hollow domes which move like Kings in chess.

11. The method of claim 10 wherein in said back row lineup for both the first and the second player each Rook-like hollow dome is designated a RAM, each Knight-like hollow dome is designated a RIM, each Bishop-like hollow dome is designated a ROM, and each King-like hollow dome is designated a RUM;

for the first player the colors being tourquoise for each said RAM, green for each said RIM, blue for each said ROM, clear for each said RUM, and blue for each of said eight solid-colored hemispheres; and for the second player the colors being purple for each said RAM, orange for each said RIM, red for each said ROM, yellow for each said RUM, and red for each of said eight solid-colored hemispheres.

* * * * *